US005980346A

United States Patent [19]

Anderson et al.

[11] Patent Number: 5,980,346

[45] Date of Patent: Nov. 9, 1999

[54] METHOD FOR FABRICATING A DISPLAY SPACER ASSEMBLY

[75] Inventors: Clifford L. Anderson; Craig Amrine, both of Tempe; Jeffery A. Whalin, Fountain Hills, all of Ariz.

[73] Assignee: Motorola, Inc., Schaumburg, Ill.

[21] Appl. No.: 08/891,968

[22] Filed: Jul. 14, 1997

Related U.S. Application Data

[62] Division of application No. 08/650,507, May 20, 1996, Pat. No. 5,708,325.

[51] Int. Cl.[6] ..... H01J 9/00

[52] U.S. Cl. ..... 445/24

[58] Field of Search ..... 445/24, 25; 313/495, 313/496, 309, 289, 292, 482

[56] References Cited

U.S. PATENT DOCUMENTS 5,543,683 8/1996 Haven et al. ..... 313/461

5,561,343 10/1996 Lowe ..... 313/482

*Primary Examiner*—Nimeshkumar D. Patel

*Assistant Examiner*—Michael J. Smith

*Attorney, Agent, or Firm*—Kate Tobin; S. Kevin Pickens; Kevin D. Wills

[57] ABSTRACT

A method is provided for fabricating a display spacer assembly (100, 400, 500) useful in the fabrication of large-area field emission displays (200, 600). The method includes the steps of: forming slots (12, 22, 32, 33) in a substrate (10, 23, 30) thereby providing a jig; providing spacers (14, 24, 34) having lower rounded edges and upper edges; placing the lower rounded edges into the slots (12, 22, 32, 33) so that the spacers (14, 24, 34) are positioned in a predetermined layout pattern over the slotted jig surface; and placing the upper edges of the spacers (14, 24, 34) in abutting engagement with a display plate (18, 10) of a field emission display.

14 Claims, 6 Drawing Sheets

METHOD FOR FABRICATING A DISPLAY SPACER ASSEMBLY

This is a division of application Ser. No. 08/650,507, filed May 20, 1996, now U.S. Pat. No. 5,708,325.

FIELD OF THE INVENTION

The present invention pertains to spacers for evacuated flat panel displays and more specifically to a method for fabricating a display spacer assembly for a field emission display.

BACKGROUND OF THE INVENTION

Field emission displays are known in the art. They include an envelope structure having an evacuated interspace region between two display plates. Electrons travel across the interspace region from a cathode plate (also known as a cathode), which includes electron-emitting devices, to an anode plate (also known as an anode), which includes deposits of light-emitting materials, or "phosphors". Typically, the pressure within the evacuated interspace region between the cathode and anode plates is on the order of $10^{-6}$ torr.

In order to provide a strong electric field (volts per unit distance between the plates) for acceleration of electrons toward the anode, while maintaining low power consumption, the distance between the cathode and anode plate is small, on the order of one millimeter. This proximity of the plates introduces the problem of potential electrical breakdown between the electron emitting surface and the inner surface of the anode plate. Such an electrical breakdown effectively ruins the display.

The cathode plate and anode plate are thin in order to provide low display weight and reduce package thickness. If the display area is small, such as in a 1" diagonal display, and a typical sheet of glass having a thickness of about 0.04" is utilized for the plates, the display will not collapse or bow significantly. However, as the display area increases the thin plates are not sufficient to withstand the pressure differential in order to prevent collapse or bowing upon evacuation of the interspace region. For example, a screen having a 30" diagonal will have several tons of atmospheric force exerted upon it. As a result of this tremendous pressure, spacers play an essential role in large area, light-weight displays. Spacers are structures being incorporated between the anode and the cathode plate, upon which electron-emitter structures, such as Spindt tips, are fabricated. The spacers, in conjunction with the thin, lightweight, plates, support the atmospheric pressure, allowing the display area to be increased with little or no increase in plate thickness.

Several schemes have been proposed to provide display spacers. These spacers and methods have several drawbacks. Methods for fabricating spacers which employ screen printing, stencil printing, or the use of glass balls suffer from the inability to provide a spacer having a sufficiently high aspect ratio (the ratio of spacer height to spacer thickness).

Other prior art methods for fabricating display spacers, such as reactive ion etching and plasma etching of deposited materials, suffer from slow throughput, slow etch rates, tapered spacer cross-sections, and etch mask degradation. Spacers comprised of lithographically defined photoactive organic compounds are not compatible with the high vacuum conditions within the display or with the elevated temperatures characteristic of the processes for manufacturing field emission flat panel displays.

Accordingly, there exists a need for a method for incorporating spacers into a field emission display which provides high throughput. There also exists a need for a spacer having a high aspect ratio which exhibits good perpendicularity with the anode and cathode plates, and which does not introduce off-gassing contaminants within the display.

BRIEF DESCRIPTION OF THE DRAWINGS

Referring to the drawings.

DESCRIPTION OF THE PREFERRED EMBODIMENT

Figure 1:
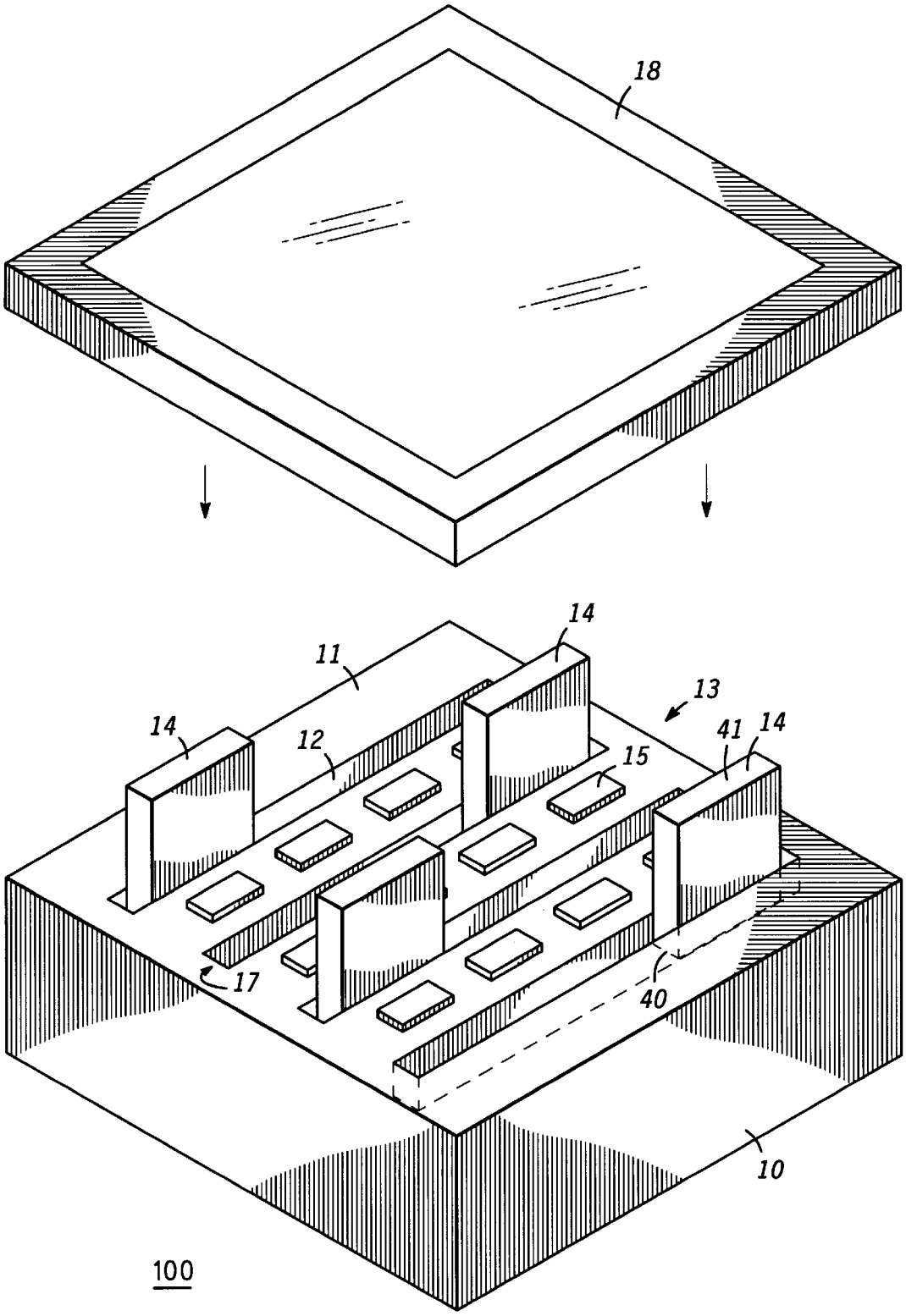
FIG. 1 is an isometric, exploded view of a display spacer assembly realized in a preferred embodiment of a method for fabricating a display spacer assembly in accordance with the present invention.

Referring now to FIG. 1, there is depicted an isometric, exploded view of a display spacer assembly 100 realized in a preferred embodiment of a method for fabricating a display spacer assembly in accordance with the present invention. In the preferred embodiment, display spacer assembly 100 includes a substrate which includes an anode 10 of a field emission display. Anode 10 has an upper surface which has a peripheral region 11 and an active region 13. Peripheral region 11 encloses active region 13. Active region 13 includes a plurality of slots 12, thereby providing a jig. Active region 13 of anode 10 includes the light-emissive phosphor deposits typical of an anode for a field emission display. Field emission display anodes are well known to one skilled in the art. Anode 10 includes a transparent substrate, such as a glass plate, having a phosphor material deposited thereon for receiving electrons and for emitting visible light. The phosphor material is deposited to define a plurality of pixels 15, which are separated by a plurality of inter-pixel regions 17. In this particular embodiment, slots 12 are formed within interpixel regions 17 to minimize disturbance of the electron-receiving, light-emitting functions of anode 10 when incorporated in the final field emission display. The anode conductor (not shown) can be provided by, for example, sputtering a black chrome onto the jig prior to the deposition of the phosphor material. Other anode conductor schemes will be apparent to one skilled in the art. Because any type of groove that is formed in anode 10 will affect the directionality of light transmitted through the transparent substrate, slots 12 are positioned one each at inter-pixel regions 17, thereby providing a uniform effect on, or processing of, the emitted light over the area of anode 10 during the operation of the resulting field emission display.

For similar reasons, slots 12 extend over the length of the light-emitting region of anode 10, within peripheral region 11. Typically, pixels 15 are regularly spaced apart and have a pitch of about 300–325 micrometers; thus, the pitch of slots 12 is also about 300–325 micrometers. Slots 12 are formed using a diamond saw, cutting into the upper surface of anode 10 to a predetermined depth. Slots 12 are then cleared of any debris from the sawing operation by passing an air stream through them, or by rinsing with deionized water. Slots 12 can also be formed by laser ablation, etching, and the like. All of these methods provide precision slots. A plurality of spacers 14, having first 40 and second opposed edges 41, are provided within slots 12, the first opposed edges 40 of spacers 14 being received by slots 12. Spacers 14 have a thermal coefficient of expansion (TCE) substantially equal to the TCE of anode 10 and cathode 18, so that spacers 14, anode 10, and cathode 18 will expand and contract in a similar manner during subsequent heating and cooling treatments. Spacers 14 are placed into slots 12 by a method such as pick-and-place, employing a mechanical gripping apparatus. Spacers 14 are made from a high dielectric material, such as glass, ceramic, or quartz. The effective length of each of spacers 14, or the length projected along the length of active region 13, is less than the length of active region 13, so that the active region of the final display is not compartmentalized. In the preferred embodiment, the length of spacers 14 is equal to their effective length since spacers 14 include straight, elongated members. This length requirement provides uniform vacuum conditions within the sealed field emission display, which results in uniform image properties over the area of the display. Spacers 14 also have a height within the range of 0.5–3 millimeters, and a width within the range of 50–300 micrometers. The distance between the inner surfaces of anode 10 and cathode 18, in this particular embodiment, is within a range of 0.8–1.3 millimeters; the maximum distance between adjacent pixels 15 is typically about 150 micrometers. The lower edges of spacers 14 are rounded or smoothed so that they do not have sharp edges, which tend to increase stress within spacers 14 when placed within slots 12 and required to bear a load. This smoothing of the lower edges can be done by beveling, etching, chamfering, grinding, flaming, and the like. Spacers 14 have a predetermined layout pattern over the surface of anode 10, designed to provide adequate standoff support against the pressure differential and provide other benefits, such as uniform vacuum conditions within the field emission display. Provision of adequate standoff may not require the placement of spacers 14 within each and every one of slots 12. In the preferred embodiment, the depth of slots 12 is equal to within 1.5 to 4 times the width of spacers 14. The depth of slots 12 needs to be great enough to provide sufficient perpendicularity of spacers 14 with anode 10 and cathode 18, and shallow enough to maintain the structural integrity of anode 10. Typically, the glass substrate of anode 10 is about 1.1 millimeters thick. The upper limit of the depth of slots 12 is equal to about 40% of the thickness of anode 10. Display spacer assembly 100 further includes cathode 18. The inner surface of cathode 18 has an active region which is enclosed by a peripheral region. The active region of cathode 18 includes a plurality of pixels. The pixels of cathode 18 include a plurality of field emission devices, which emit electrons during operation of the final field emission display. The emitted electrons are received by pixels 15 of anode 10. The plurality of pixels of cathode 18 also define a plurality of inter-pixel regions in the active region of cathode 18. These inter-pixel regions of cathode 18 are in registration with inter-pixel regions 17 of anode 10, as will be illustrated in greater detail with reference to FIG. 3. The second opposed edges of spacers 14 are contacted with portions of the inter-pixel regions of cathode 18, thereby precluding interference with the electron-emitting function of the pixels of cathode 18.

Figure 2:
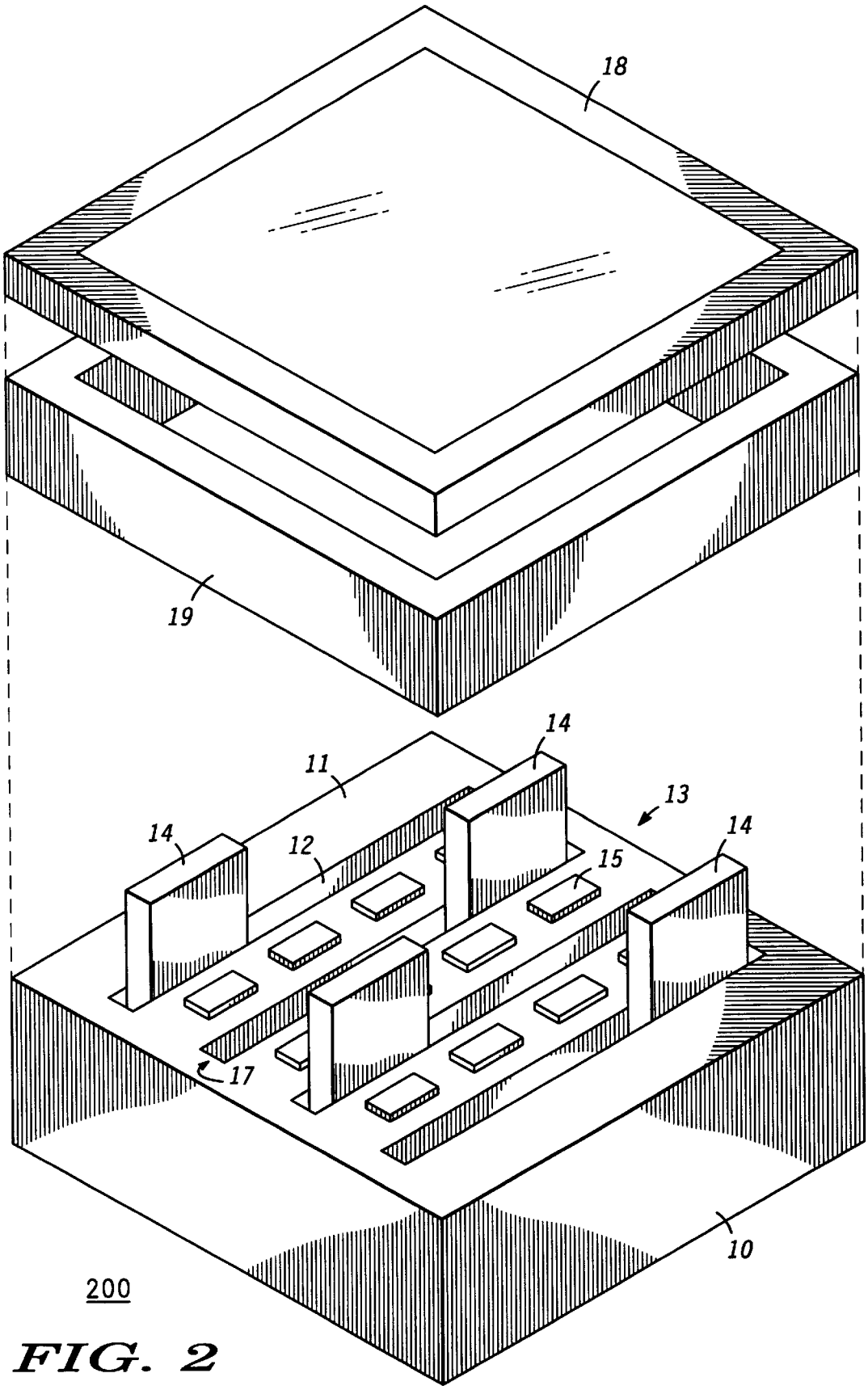
FIG. 2 is an isometric, exploded view of a preferred embodiment of a field emission display, including the display spacer assembly of FIG. 1, in accordance with the present invention.

Referring now to FIG. 2, there is depicted an isometric, exploded view of a preferred embodiment of a field emission display (FED) 200, which includes display spacer assembly 100 of FIG. 1, in accordance with the present invention. FED 200 includes all the elements of display spacer assembly 100 and further includes a frame 19 having first and second opposed surfaces. The first opposed surface is affixed to peripheral region 11 of anode 10 and the second opposed surface is affixed to a similar peripheral region (not shown) of cathode 18, thereby defining an interspace region. Hermetic seals are provided between display plates 10, 18 and frame 19 so that a vacuum can be provided within the interspace region. Frame 19 is affixed to display plates 10, 18 by applying a thin layer of frit on the first and second opposed surfaces, prior to contacting them with the peripheral regions of anode 10 and cathode 18, respectively, then heat-treating the fritted structure in an appropriate manner to form a hermetic seal with the frit. FED 200 also includes the electronics and conductor layouts to address the field emission devices comprising the pixels of cathode 18 and to provide the anode conductor(s) of anode 10, all of which are known to one of ordinary skill in the art.

Figure 3:
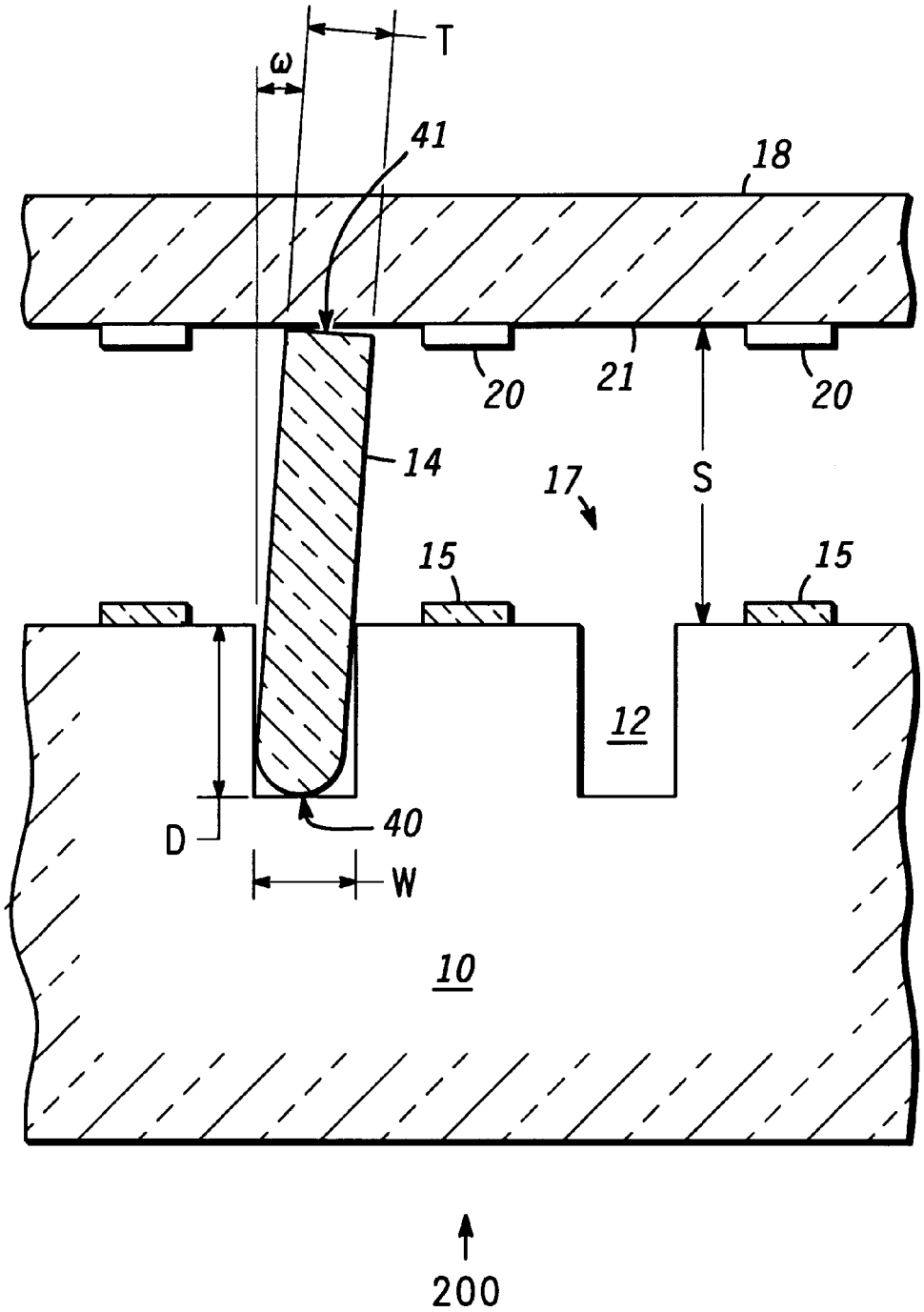
FIG. 3 is a cross-sectional view of a portion of the field emission display of FIG. 2, illustrating the analysis of spacer alignment.

Referring now to FIG. 3, there is depicted a cross-sectional view of a portion of display spacer assembly 100 of FIGS. 1 and 2, illustrating the alignment of spacers 14 within slots 12 and relative to anode 10 and cathode 18. To provide adequate load-bearing ability, spacers 14 need to be substantially perpendicular with respect to anode 10 and cathode 18. As illustrated in FIG. 3, spacers 14 may tilt when placed within slots 12, resulting in a tilting angle, omega, as shown. Adequate perpendicularity is achieved if the tilting angle is less than about 2 degrees. Typically, the distance, S, between the inner surfaces of anode 10 and cathode 18 is about 1 millimeter, as dictated by electric field and power requirements and the like. Similarly, the layout of pixels 15 limits the width, T, of spacers 14, which, in the preferred embodiment, is about 100 micrometers. Due to precision limitations of the formation of slots 12, a maximum, or worst-case, slot width, W, is assumed to be 5% greater that the spacer width, T. To provide a tilting angle of about 1 degree, given the above specifications, the depth, D, of slots 12 is at least 3 times the width, T, of spacers 14. A similar type of analysis can be performed for various configurations of S, W, and T. When the active region of the inner surface of cathode 18 is contacted with the second opposed edges of spacers 14, the second opposed edges of spacers 14 contact portions of a plurality of inter-pixel regions 21. Inter-pixel regions 21 include those portions of the inner surface of cathode 18 which lie between a plurality of pixels 20, which include the electron-emitting structures. This configuration precludes interference with the electron emitting function of cathode 18. By utilizing a method in accordance with the present invention, all of spacers 14 are simultaneously aligned with a display plate and simultaneously made perpendicular with respect to the display plate; by not requiring individual alignment, or individual perpendicularization, fabrication of the display is simplified and throughput is increased.

In another embodiment of a method for fabricating a display spacer assembly in accordance with the present invention, slots 12 are formed in portions of inter-pixel regions 21 of cathode 18; the rounded first opposed edges of spacers 14 are then placed within slots 12; and anode 10 is placed upon the upper edges of spacers 14, so that the second opposed edges contact inter-pixel regions 17 of anode 10. In this particular embodiment, slots 12 are not required to be disposed at each and every one of inter-pixel regions 18, and they are not required to be regularly spaced apart or to extend the length of the active region of cathode 18. This is because slots 12 in cathode 18 will not redirect light, in a manner that slots 12 in anode 10 will redirect light. In this particular embodiment, the layout of slots 12 in cathode 18 is determined by the predetermined layout of spacers 14, which is determined by the standoff requirements. For ease of manufacturing, however, a regularly spaced apart configuration, extending the length of the active region is desirable.

Figure 4:
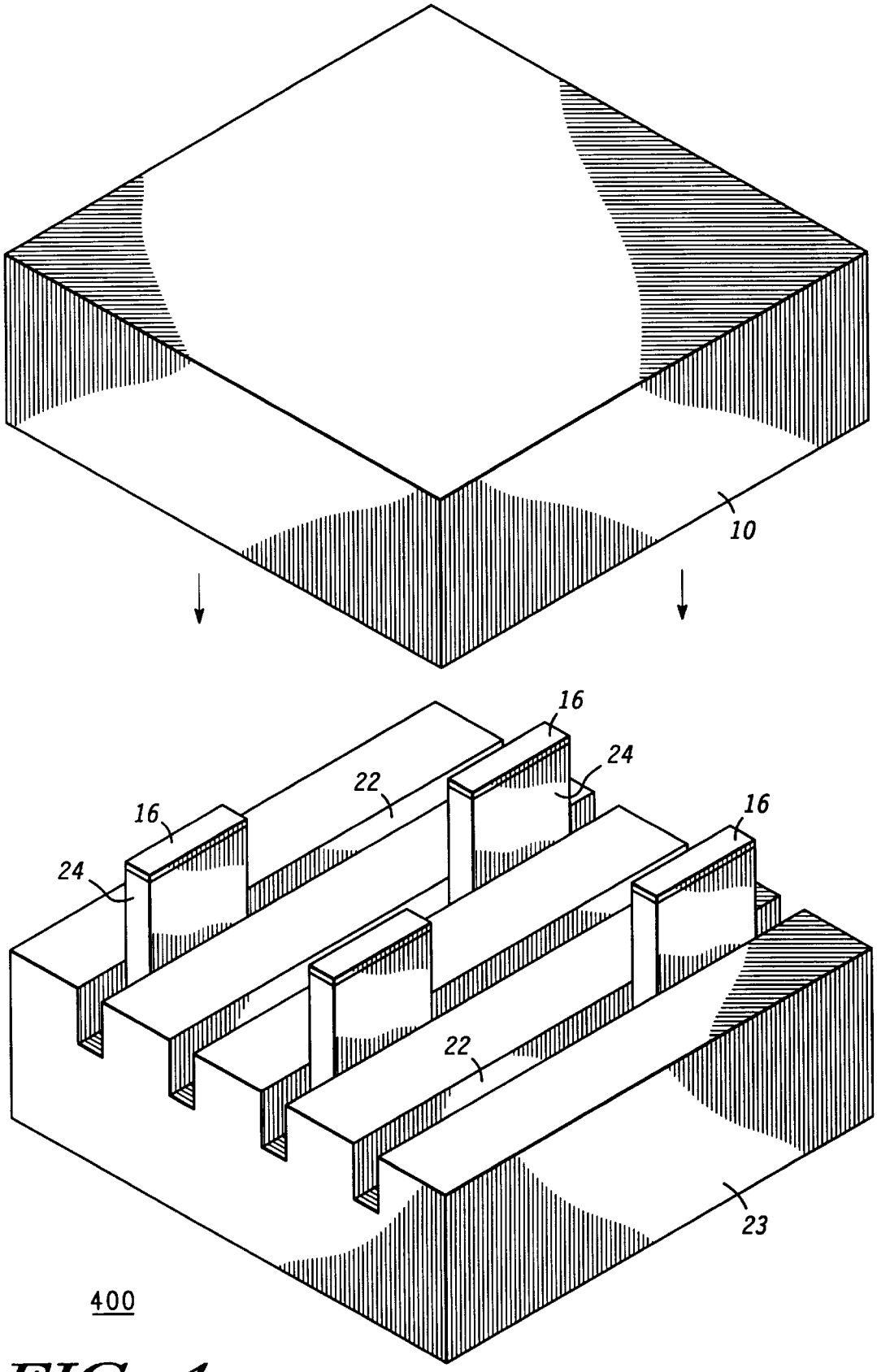
FIG. 4 is an isometric, exploded view of a display spacer assembly realized in another embodiment of a method for fabricating a display spacer assembly in accordance with the present invention.

Referring now to FIG. 4, there is depicted an isometric, exploded view of a display spacer assembly 400 realized by performing the steps of another embodiment of a method for fabricating a display spacer assembly in accordance with the present invention. In this particular embodiment, the slotted jig does not include one of the display plates of a field emission display. A substrate 23 is provided having an upper surface in which a plurality of slots 22 are formed, thereby providing a jig. Substrate 23 is made from a hard material, such as glass, ceramic, quartz, and the like. A plurality of spacers 24 are placed within slots 22 in a manner similar to that described with reference to FIG. 1. Spacers 24 are made from a high-dielectric material, such as quartz, ceramic, or glass. In this particular embodiment, spacers 24 have a TCE equal to the TCE of the substrate 23. Spacers 24 have first and second opposed edges. The first opposed edges of spacers 24 are smoothed or rounded to substantially remove sharp edges which can create high stress in spacers 24. The smoothed first opposed edges are then placed within slots 22, so that spacers 24 have a predetermined layout pattern to subsequently provide adequate standoff support within a field emission display. A thin layer 16 of frit, or other adequate adhesive, is formed on the second opposed edges of spacers 24. Then, active region 13 (not shown) of anode 10 is placed in abutting engagement with the second opposed edges of spacers 24, thereby providing display spacer assembly 400. In order to provide adequate perpendicularity between spacers 24 and anode 10, slots 22 have a depth equal to at least 3 times the width of spacers 24, and a width of up to 5% greater than the width of spacers 24. The depth of All slots 22 is less than the height of spacers 24, so that the second opposed edges of spacers 24 are disposed outside of slots 22 when spacers 24 are placed therein. The depth of slots 22 is shallow enough to maintain the mechanical integrity of the jig, to ensure precision placement of spacers 24 onto anode 10. The height of spacers 24 is equal to a predetermined spacing between the inner surfaces of the display plates of the final FED. After the active region of anode 10 is contacted with the second opposed edges of spacers 24, so that the active region of anode 10 opposes the upper surface of substrate 23, display spacer assembly 400 is heated in a manner adequate to form a bond between the second opposed edges of spacers 24 and the contacted surface of anode 10, thereby affixing spacers 24 to anode 10, thereby providing a spacer sub-assembly, which includes anode 10 and spacers 24 affixed thereon. In other embodiments of a method in accordance with the present invention, the second opposed edges of spacers 24 are affixed to the active region of anode 10 by other methods, such as adhesion. In yet other embodiments, the second opposed edges of spacers 24 are contacted with the active region of cathode 18, instead of anode 10.

Figure 5:
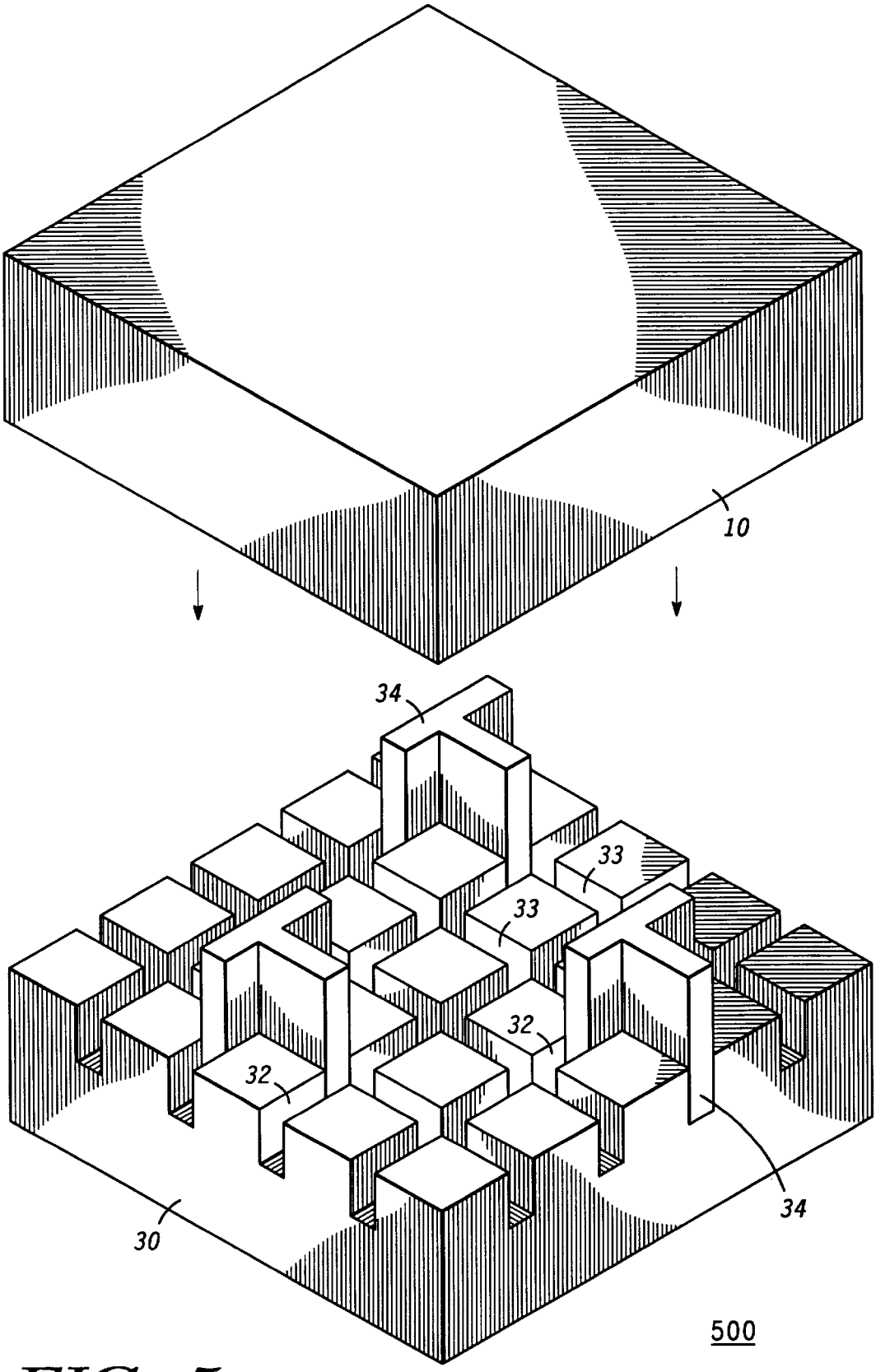
FIG. 5 is an isometric, exploded view of a display spacer assembly realized in another embodiment of a method for fabricating a display spacer assembly in accordance with the present invention.

Referring now to FIG. 5 there is depicted an isometric view of a display spacer assembly 500 realized by performing the steps of another embodiment of a method in accordance with the present invention. In this particular embodiment, a substrate 30, not including one of the display plates, has a plurality of slots 32 which are intersected by another plurality of slots 33. Slots 33 are perpendicular to slots 32. This configuration of slots is capable of holding a plurality of stand-alone spacers 34, which, in this particular embodiment, are T-shaped. In a method for fabricating a field emission display from display spacer assembly 500, in accordance with the present invention, no adhesive or frit is deposited on the second opposed edges of stand-alone spacers 34. The active region of anode 10 is placed in abutting engagement with the second opposed edges of stand-alone spacers 34. Then, display spacer assembly 500 is inverted so that the jig is on top. Thereafter, the jig is removed so that stand-alone spacers 34 remain upright upon active region 13 (not shown) of anode 10. Then, the active region of cathode 18 is contacted with the first opposed edges of stand-alone spacers 34. This method is faster and more precise than a pick and place method for positioning stand-alone spacers 34 on one of the display plates during the fabrication of a FED. In this particular embodiment, the TCE of substrate 30 need not be equal to the TCE of stand-alone spacers 34, since display spacer assembly 500 does not undergo a heat treatment, such as the heat treatment required during the affixation step described with reference to FIG. 4.

Figure 6:
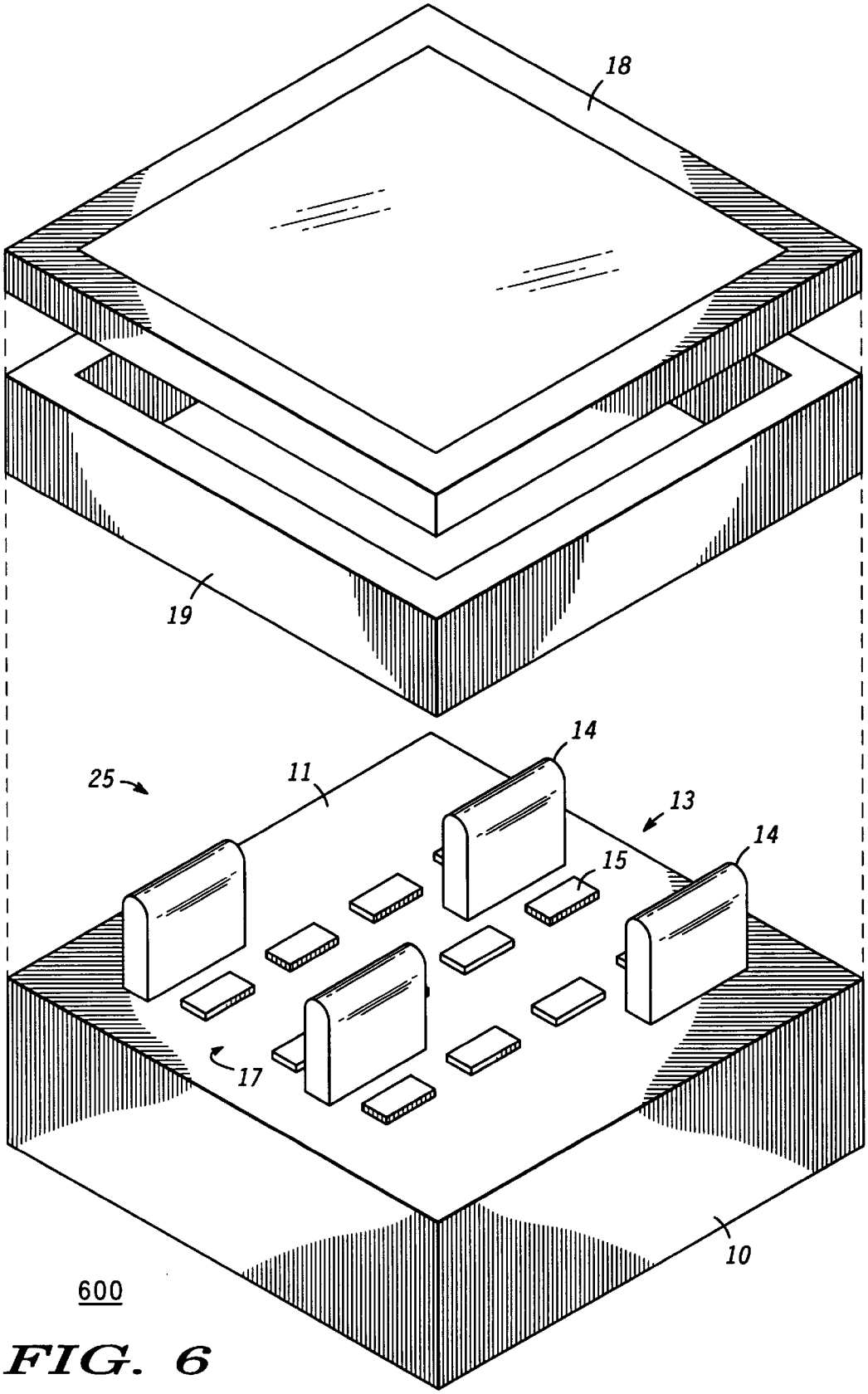
FIG. 6 is an isometric, exploded view of another embodiment of a field emission display, including elements of the display spacer assembly of FIG. 4, in accordance with the present invention.

Referring now to FIG. 6, there is depicted an isometric, exploded view of a field emission display 600 realized by performing various steps of an embodiment of a method for fabricating a field emission display, in accordance with the present invention. Field emission display 600 is fabricated by first providing a spacer sub-assembly 25, as described with reference to FIG. 4. Again, spacer sub-assembly 25 includes anode 10 and spacers 24 being affixed thereon. Next, cathode 18 and frame 19 are attached. Frame 19 has first and second opposed surfaces. The first opposed surface is affixed to peripheral region 11 of anode 10 and the second opposed surface is affixed to a similar peripheral region (not shown) of cathode 18. The active region of cathode 18 is positioned in registration with active region 13 of anode 10. The first opposed edges of spacers 24 are contacted with portions of the inter-pixel regions of cathode 18, as illustrated in FIG. 3. Hermetic seals are provided between anode 10, cathode 18, and frame 19 so that a vacuum can be provided within the interspace region formed therein. Frame 19 is affixed to anode 10 and cathode 18 by applying a thin layer of frit on the first and second opposed surfaces of frame 19, prior to contacting hem with the peripheral regions of anode 10 and cathode 18, respectively. Then, after contacting the fritted opposed surfaces with the peripheral regions, the fritted structure is heat treated in an appropriate manner to form a hermetic seal with the frit. Other suitable sealing methods will be apparent to one of ordinary skill in the art. FED 200 also includes the electronics and conductor layouts to address the field emission devices comprising the pixels of cathode 18 and to provide the anode conductor(s) of anode 10, all of which are known to one of ordinary skill in the art. The interspace region defined by the active regions of anode 10, cathode 18 and by frame 19 is thereafter evacuated.

In another embodiment of a method for fabricating a FED, in accordance with the present invention, the initial spacer sub-assembly includes cathode 18 and spacers 24 being affixed thereon, in a manner similar to that described with reference to FIG. 4. The subsequent fabrication steps are similar to those described with reference to FIG. 6 and include the step of placing anode 10 in abutting engagement with the first opposed edges of spacers 24.

While We have shown and described specific embodiments of the present invention, further modifications and improvements will occur to those skilled in the art. We desire it to be understood, therefore, that this invention is not limited to the particular forms shown and We intend in the appended claims to cover all modifications that do not depart from the spirit and scope of this invention.

What is claimed is:

1. A method for fabricating a display spacer assembly for a field emission display comprising the steps of:

providing a substrate having an upper surface;

forming in the upper surface of the substrate a plurality of slots thereby providing a jig;

providing a plurality of spacers having first and second opposed edges, each of the plurality of spacers having a height within a range of 0.5–3 millimeters and a width within a range of 50–300 micrometers; wherein each slot has a depth equal to within 1.5 to 4 times the width of each of the plurality of spacer;

placing within the plurality of slots the first opposed edges of the plurality of spacers, the plurality of spacers being spaced apart and having a predetermined layout pattern;

providing a display plate having an inner surface having a peripheral region defining an active region having a first length, each of the plurality of spacers having an effective length being less than the first length of the active region so that vacuum uniformity is provided within the field emission display; and contacting the active region of the display plate with the second opposed edges of the plurality of spacers so that the second opposed edges of the plurality of spacers are in abutting engagement with the active region.

2. A method for fabricating a display spacer assembly for a field emission display comprising the steps of:

providing a substrate having an upper surface;

forming in the upper surface of the substrate a plurality of slots thereby providing a jig;

providing a plurality of spacers having first and second opposed edges, each of the plurality of spacers having a height within a range of 0.5–3 millimeters and a width within a range of 50–300 micrometers;

smoothing the first opposed edges of the plurality of spacers;

placing within the plurality of slots the first opposed edges of the plurality of spacers, the plurality of spacers being spaced apart and having a predetermined layout pattern;

providing a display plate having an inner surface having a peripheral region defining an active region having a first length, each of the plurality of spacers having an effective length being less than the first length of the active region so that vacuum uniformity is provided within the field emission display; and contacting the active region of the display plate with the second opposed edges of the plurality of spacers so that the second opposed edges of the plurality of spacers are in abutting engagement with the active region.

3. A method for fabricating a display spacer assembly for a field emission display comprising the steps of:

providing a substrate having an upper surface;

forming in the upper surface of the substrate a plurality of slots thereby providing a jig;

providing a plurality of spacers having first and second opposed edges, each of the plurality of spacers having a height within a range of 0.5–3 millimeters and a width within a range of 50–300 micrometers; wherein each of the plurality of slots has a width being between 1–5% wider than the width of each of the plurality of spacers;

placing within the plurality of slots the first opposed edges of the plurality of spacers, the plurality of spacers being spaced apart and having a predetermined layout pattern;

providing a display plate having an inner surface having a peripheral region defining an active region having a first length, each of the plurality of spacers having an effective length being less than the first length of the active region so that vacuum uniformity is provided within the field emission display; and contacting the active region of the display plate with the second opposed edges of the plurality of spacers so that the second opposed edges of the plurality of spacers are in abutting engagement with the active region.

4. A method for fabricating a display spacer assembly for a field emission display comprising the steps of:

providing a substrate having an upper surface;

forming in the upper surface of the substrate a plurality of slots thereby providing a jig;

providing a plurality of spacers having first and second opposed edges, each of the plurality of spacers having a height within a range of 0.5–3 millimeters and a width within a range of 50–300 micrometers; wherein each of the plurality of slots has a depth equal to at least three times the width of each of the plurality of spacers and less than the height of each of the plurality of spacers;

placing within the plurality of slots the first opposed edges of the plurality of spacers, the plurality of spacers being spaced apart and having a predetermined layout pattern;

providing a display plate having an inner surface having a peripheral region defining an active region having a first length, each of the plurality of spacers having an effective length being less than the first length of the active region so that vacuum uniformity is provided within the field emission display; and contacting the active region of the display plate with the second opposed edges of the plurality of spacers so that the second opposed edges of the plurality of spacers are in abutting engagement with the active region.

5. A method for fabricating a field emission display comprising the steps of:

providing a first display plate having an inner surface having a peripheral region defining an active region;

forming in the active region of the first display plate a plurality of slots;

providing a plurality of spacers having first and second opposed edges, the plurality of slots being designed to receive the plurality of spacers;

smoothing the first opposed edges of the plurality of spacers;

placing within the plurality of slots the first opposed edges of the plurality of spacers, the plurality of spacers being spaced apart over the active region of the first display plate;

providing a second display plate having an inner surface having a peripheral region defining an active region;

positioning the second display plate in opposed spaced relationship with respect to the first display plate;

contacting the active region of the second display plate with the second opposed edges of the plurality of spacers, the active region of the second display plate being in registration with the active region of the first display plate thereby providing a display spacer assembly;

providing between the first and second display plates a frame having first and second opposed surfaces, the active regions of the first and second display plates and the frame defining an interspace region;

providing field emission devices within the interspace region; and evacuating the interspace region.

6. A method for fabricating a field emission display as claimed in claim 5 wherein the first display plate includes an anode and the second display plate includes a cathode.

7. A method for fabricating a field emission display as claimed in claim 5 wherein the first display plate includes a cathode and the second display plate includes an anode.

8. A method for fabricating a field emission display comprising the steps of:

providing a substrate having an upper surface;

forming in the upper surface of the substrate a plurality of slots thereby providing a jig;

providing a plurality of spacers having first and second opposed edges, the plurality of slots being designed to receive the plurality of spacers;

smoothing the first opposed edges of the plurality of spacers;

placing within the plurality of slots the first opposed edges of the plurality of spacers, the plurality of spacers being spaced apart and having a predetermined layout pattern;

providing a first display plate having an inner surface having a peripheral region defining an active region; and contacting active region of the first display plate with the second opposed edges of the plurality of spacers so that the second opposed edges of the plurality of spacers are in abutting engagement with the active region of the first display plate thereby providing a display spacer assembly;

affixing the second opposed edges of the plurality of spacers to the active region of the first display plate so In that the first display plate and the plurality of spacers affixed thereon define a spacer sub-assembly;

removing the jig from the spacer sub-assembly;

providing a second display plate having an inner surface having a peripheral region defining an active region;

positioning the active region of the first display plate in registration with the active region of the second display plate;

contacting the active region of the second display plate with the first opposed edges of the plurality of spacers so that the first opposed edges of the plurality of spacers are in abutting engagement with the active region of the second display plate;

providing between the first and second display plates a frame so that the active regions of the first and second display plates and the frame define an interspace region providing field emission devices within the interspace region; and evacuating the interspace region.

9. A method for fabricating a field emission display as claimed in claim 8 wherein the first display plate includes an anode and the second display plate includes a cathode.

10. A method for fabricating a field emission display as claimed in claim 8 wherein the first display plate includes a cathode and the second display plate includes an anode.

11. A method for fabricating a field emission display comprising the steps of:

providing a substrate having an upper surface;

forming in the upper surface of the substrate a plurality of slots thereby providing a jig;

providing a plurality of stand-alone spacers having first and second opposed edges, the plurality of slots being designed to receive the plurality of stand-alone spacers;

smoothing the first opposed edges of the plurality of stand-alone spacers;

placing within the plurality of slots the first opposed edges of the plurality of stand-alone spacers, the plurality of stand-alone spacers being spaced apart and having a predetermined layout pattern;

providing a first display plate having an inner surface having a peripheral region defining an active region; and contacting active region of the first display plate with the second opposed edges of the plurality of stand-alone spacers so that the second opposed edges of the plurality of stand-alone spacers are in abutting engagement with the active region of the first display plate thereby providing a display spacer assembly;

inverting the display spacer assembly so that the jig is on top;

removing the jig from the display spacer assembly so that the plurality of stand-alone spacers remain upright upon the active region of the first display plate;

providing a second display plate having an inner surface having a peripheral region defining an active region;

positioning the active region of the second display plate in registration with the active region of the first display plate;

contacting the active region of the second display plate with the first opposed edges of the plurality of spacers so that the first opposed edges of the plurality of spacers are in abutting engagement with the active region of the second display plate;

providing between the first and second display plates a frame so that the active regions of the first and second display plates and the frame define an interspace region;

providing field emission devices within the interspace region; and evacuating the interspace region.

12. A method for fabricating a field emission display as claimed in claim 11 wherein the first display plate includes an anode and the second display plate includes a cathode.

13. A method for fabricating a field emission display as claimed in claim 11 wherein the first display plate includes a cathode and the second display plate includes an anode.

14. A method for fabricating a field emission display as claimed in claim 11 wherein the plurality of stand-alone spacers include a plurality of T-shaped spacers.

* * * * *

UNITED STATES PATENT AND TRADEMARK OFFICE

CERTIFICATE OF CORRECTION

PATENT NO. : 5,980,346
DATED : November 9, 1999
INVENTOR(S) : Anderson et al.

It is certified that error appears in the above-identified patent and that said Letters Patent is hereby corrected as shown below:

Column 9, claim 8,
Line 51, delete "In".

Signed and Sealed this

Twenty-ninth Day of January, 2002

*Attest:*

*Attesting Officer*

JAMES E. ROGAN
*Director of the United States Patent and Trademark Office*